United States Patent [19]

Russell

[11] 3,955,733

[45] May 11, 1976

[54] RECORD HOLDER CARRYING CASE

[76] Inventor: William A. Russell, 1214 Beverly, Springfield, Ohio 45504

[22] Filed: June 13, 1974

[21] Appl. No.: 478,942

[52] U.S. Cl. ..... 224/45 K; 206/310; 211/40

[51] Int. Cl.[2] ..... B65D 71/00

[58] Field of Search ..... 224/45 K, 45 R, 49, 224/46 R; 206/45.17, 45.13, 310; 211/49, 40, 41

[56] References Cited

UNITED STATES PATENTS

| | | | |
|---|---|---|---|
| 956,516 | 5/1910 | Brown | 211/40 |
| 1,960,073 | 5/1934 | Warner | 206/45.13 |
| 2,270,611 | 1/1942 | Spaulding | 224/46 R |
| 2,278,214 | 3/1942 | Pearson | 224/45 K |
| 2,500,773 | 3/1950 | Robins | 206/310 |
| 2,501,037 | 3/1950 | Fox | 224/45 K |
| 2,566,300 | 9/1951 | Adam | 206/310 |

FOREIGN PATENTS OR APPLICATIONS

| | | | |
|---|---|---|---|
| 1,121,765 | 7/1968 | United Kingdom | 206/310 |

*Primary Examiner*—Robert J. Spar
*Assistant Examiner*—Kenneth Noland

[57] ABSTRACT

A case within which record player records can be conveniently carried so that the records cannot be damaged while in transit, the case consisting of a container molded of plastic material and which is integral with several posts formed on one interior side wall so that the records can be hooked on to the posts, and the case, in one design of the invention, being reversible inside out so to form a stand with the posts on the outer side during use so to conveniently locate records that are desired to be played.

1 Claim, 6 Drawing Figures

RECORD HOLDER CARRYING CASE

This invention relates generally to carrying cases of luggage type.

A principal object of the present invention is to provide a case for carrying phonograph or player records in a safe manner so that they cannot become scratched or otherwise damaged.

Another object is to provide a record holder carrying case which in one design thereof is reversible so to form a stand from which record selection is made easier.

Other objects are to provide a record holder carrying case which is simple in design, inexpensive to manufacture, rugged in construction, easy to use, and efficient in operation.

These and other objects will be readily evident upon a study of the following specification and the accompanying drawing, wherein.

Figure 1:
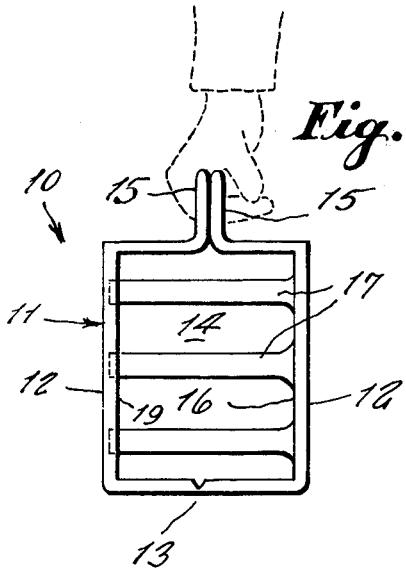
FIG. 1 is an end elevation view of one design of the invention showing the case being carried.
Figure 2:
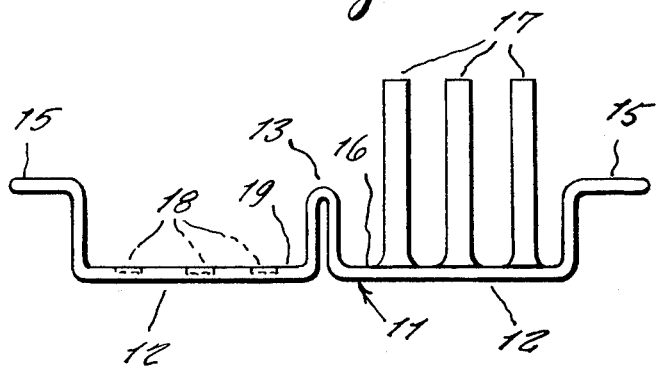
FIG. 2 is an end elevation view thereof opened up so to permit removal of any selected records.

Referring now to the drawing in detail, and more particularly to FIGS. 1 and 2 thereof at this time, the reference numeral 10 represents a record holder carrying case according to the present invention wherein the same consists of a plastic case 11 comprised of two enclosing sides 12 that are pivotable about a portion 13 so that when pivoted together the sides form an enclosure 14, and when pivoted away, as shown in FIG. 2, the enclosure is accessible.

Handles 15 are provided on opposite ends of the device so that when brought together, they can both be held in the hand, as shown in FIG. 1.

One side wall 16 has a series of posts 17 integral therewith, so to be contained within the enclosure when the case is closed, at which time the terminal ends of the posts fit into notches 18 formed on the opposite side wall 19.

In operative use, records are mounted upon the posts by the record center hole being fitted thereupon, so that each post contains many records. When the case is closed, the notches support the posts so to not bend when heavily loaded with records. When the case is open, as shown in FIG. 2, records can be easily removed or replaced on the posts.

Figure 3:
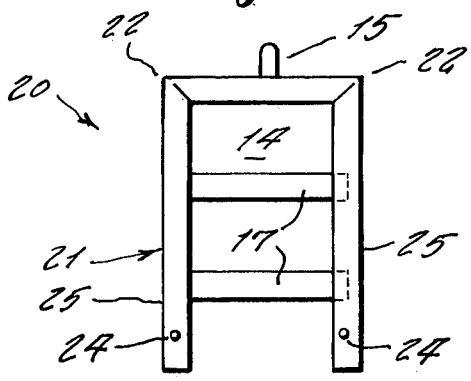
FIG. 3 is an end elevation view of a modified design thereof showing the case closed.
Figure 4:
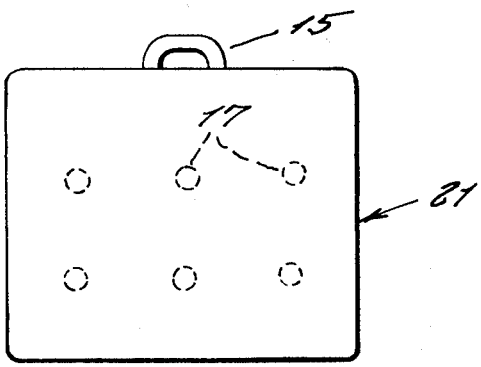
FIG. 4 is a side elevation view thereof.
Figure 5:
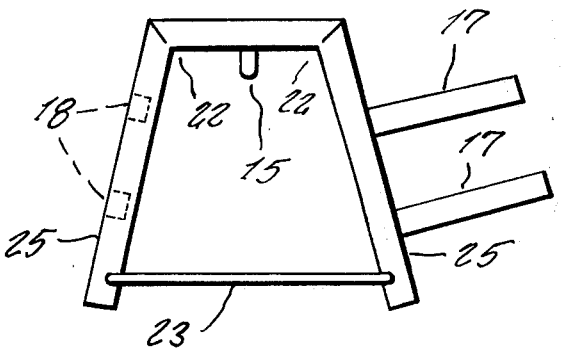
FIG. 5 is an end elevation view of the case of FIG. 3, shown reversed inside out so to form a record stand.

In FIGS. 3 to 5, another record holder carrying case 20 is shown that incorporates the above described features generally, except that in this design, the case 21 is pivotable at portions 22 so that it can be reversed inside out so that it can be used as a carrying case, as shown in FIG. 3, or as a stand, as shown in FIG. 5, at which time the post extends sidewardly out so to conveniently allow record removal or replacement. A U-shaped brace 23 between holes 24 in side walls 25 makes the stand rigid.

Figure 6:
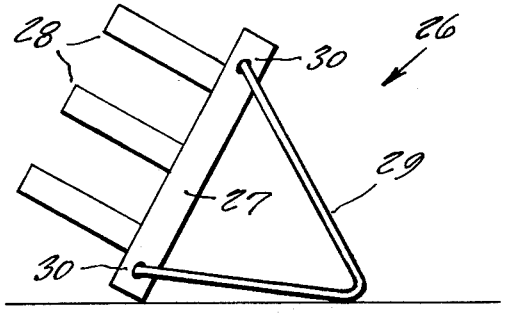
FIG. 6 is an end elevation view of a record stand that is collapsible so it can be easily carried inside a conventional suitcase.

In FIG. 6, a model of stand 26 is shown that can be dismantled so to fit in a suitcase, and consists of panel 27 having posts 28, and a removable brace 29 on each end receivable in holes 30.

I claim:

1. In combination with records and a record holder, said record holder being carried by a handle, said record holder while being carried has a base and downwardly extended side member on two opposite ends of said base, and extending across said side members are plural record holder post members, said record holder is also supported on a surface having said side members supported on said surface while said side members are inverted substantially 180 degrees from the hand carried position, said record holder while in the supported position having brace means connected to said side members adjacent said supporting surface, said record holder having said record post members extending outwardly from only a side member while said record holder is supported on said surface.

* * * * *